US011562855B2

(12) United States Patent
Andersson et al.

(10) Patent No.: US 11,562,855 B2
(45) Date of Patent: Jan. 24, 2023

(54) LAMINATION STACK FOR AN IGNITION SYSTEM

(71) Applicant: Walbro LLC, Tucson, AZ (US)

(72) Inventors: Martin N. Andersson, Caro, MI (US); Cyrus M. Healy, Ubly, MI (US); Gerald J. LaMarr, Jr., Bay City, MI (US)

(73) Assignee: Walbro LLC, Cass City, MI (US)

( * ) Notice: Subject to any disclaimer, the term of this patent is extended or adjusted under 35 U.S.C. 154(b) by 607 days.

(21) Appl. No.: 16/605,024

(22) PCT Filed: Apr. 20, 2018

(86) PCT No.: PCT/US2018/028479
§ 371 (c)(1),
(2) Date: Oct. 14, 2019

(87) PCT Pub. No.: WO2018/195374
PCT Pub. Date: Oct. 25, 2018

(65) Prior Publication Data

US 2021/0134524 A1 May 6, 2021

Related U.S. Application Data

(60) Provisional application No. 62/487,538, filed on Apr. 20, 2017.

(51) Int. Cl.
*H01F 38/12* (2006.01)
*H01F 27/245* (2006.01)
*H01F 27/26* (2006.01)

(52) U.S. Cl.
CPC ..... *H01F 38/12* (2013.01); *H01F 27/245* (2013.01); *H01F 27/266* (2013.01)

(58) Field of Classification Search
CPC ..... H01F 27/266
USPC ..... 123/350, 406.56, 595, 596, 599, 600, 123/605, 618
See application file for complete search history.

(56) References Cited

U.S. PATENT DOCUMENTS

| | | | | |
|---|---|---|---|---|
| 4,483,306 | A | 11/1984 | Kawashima | |
| 4,829,970 | A | 5/1989 | Carmichael | |
| 7,000,595 | B2 * | 2/2006 | Andersson | F02P 5/1504 123/480 |
| 2002/0185108 | A1 * | 12/2002 | Fewell, Jr. | F02P 5/06 123/406.56 |

(Continued)

OTHER PUBLICATIONS

Written Opinion & International Search Report for PCT/US2018/028479 dated Aug. 7, 2018, 11 pages.

*Primary Examiner* — Phutthiwat Wongwian
*Assistant Examiner* — Arnold Castro
(74) *Attorney, Agent, or Firm* — Reising Ethington P.C.

(57) ABSTRACT

In at least some implementations, a lamination stack includes a plurality of plates coupled together, each plate including at least one leg that collectively define a leg of the stack, with the leg of the stack arranged so that a wire coil may be arranged on the leg of the stack, and wherein the leg of the stack includes a location feature arranged to facilitate location of the stack relative to an adjacent component. In at least some implementations, the location feature may be integrally formed with at least one of the plates, and may be defined by a projection extending from a free end of at least one leg of the stack.

18 Claims, 4 Drawing Sheets

(56) References Cited

U.S. PATENT DOCUMENTS

| | | | | |
|---|---|---|---|---|
| 2007/0034190 | A1* | 2/2007 | Schieber | F02P 9/002 123/601 |
| 2007/0181099 | A1* | 8/2007 | Andersson | F02P 5/1506 123/339.11 |
| 2008/0178841 | A1* | 7/2008 | Andersson | F02P 3/0815 123/406.57 |
| 2009/0084368 | A1 | 4/2009 | Kiessling et al. | |
| 2010/0012084 | A1 | 1/2010 | Andersson et al. | |
| 2016/0076506 | A1 | 3/2016 | Andersson et al. | |

* cited by examiner

LAMINATION STACK FOR AN IGNITION SYSTEM

REFERENCE TO RELATED APPLICATIONS

This application claims the benefit of U.S. Provisional Application Ser. No. 62/487,538 filed on Apr. 20, 2017, the entire contents of which are incorporated herein by reference in its entirety.

TECHNICAL FIELD

The present disclosure relates generally to a lamination stack and ignition module for an ignition system.

BACKGROUND

An ignition module for an engine may include one or more coils of wire in which energy is generated and through which energy flows to a spark plug, to cause an ignition event in the engine. The coils may be wrapped or coiled around a lamination stack that is positioned adjacent to a flywheel on which one or more magnets are mounted. As the flywheel rotates, the magnets pass by the lamination stack and coils and induce electrical energy in the coils. The position of the lamination stack relative to the flywheel may affect the energy generated in the system and the operation of the system.

SUMMARY

In at least some implementations, a lamination stack includes a plurality of plates coupled together, each plate including at least one leg that collectively define a leg of the stack, with the leg of the stack arranged so that a wire coil may be arranged on the leg of the stack, and wherein the leg of the stack includes a location feature arranged to facilitate location of the stack relative to an adjacent component. In at least some implementations, the location feature may be integrally formed with at least one of the plates.

In at least some implementations, the location feature includes at least one projection extending from one or more of the plates, and the projection may be integrally formed with at least one of the plates. The projection may include a frangible portion or fracture feature providing a location at which the projection will break away from said one or more of the plates. The fracture feature may be defined by a weakened portion of a projection. The projection may be constructed to engage the adjacent component and to be worn down by movement of the adjacent component relative to the projection. The projection may have a surface area at an outer end of the projection that is less than ⅓ of the surface area of the end of the leg of the stack. And the projection may extend from the end of a plate by a distance of 0.7 mm or less.

In at least some implementations, the coupled together plates define a pair of outer plates at each side of the stack and the location feature is defined by at least one of the outer plates which is longer than a plate adjacent to the longer plate. The longer plate may extend at least 1 mm beyond the plate adjacent to the longer plate. In at least some implementations, the coupled together plates define a pair of outer plates at each side of the stack and the location feature is defined by at least one of the plates adjacent to an outer plate which is shorter than the outer plate. At least one of the plates adjacent to an outer plate may be at least 1.5 mm shorter than the adjacent outer plate.

In at least some implementations, an assembly includes a stack and at least one coil located on one leg of the stack and at least one other coil located on the other leg of the stack. The stack is defined by a plurality of plates that are coupled together, and has a first leg and a second leg spaced from the first leg. Each plate includes at least two legs and the legs of each plate collectively define the first and second legs of the stack, and wherein each leg of the stack includes a location feature arranged to facilitate location of the stack relative to an adjacent component.

In at least some implementations, the first leg and second leg are coupled together by a base, and wherein each plate includes a base extending between said at least two legs of each plate. The first leg and second leg may include a free end and the location feature may be arranged at the free end of at least one of the first leg and the second leg. The location feature may include at least one projection extending from a free end of at least one leg of at least one plate. The projection may have an outer end and a surface area at the outer end of the projection that is less than ⅓ of the surface area of the end of the leg of the stack on which the projection is provided.

BRIEF DESCRIPTION OF THE DRAWINGS

The following detailed description of certain embodiments and best mode will be set forth with reference to the accompanying drawings, in which.

DETAILED DESCRIPTION

Figure 1:
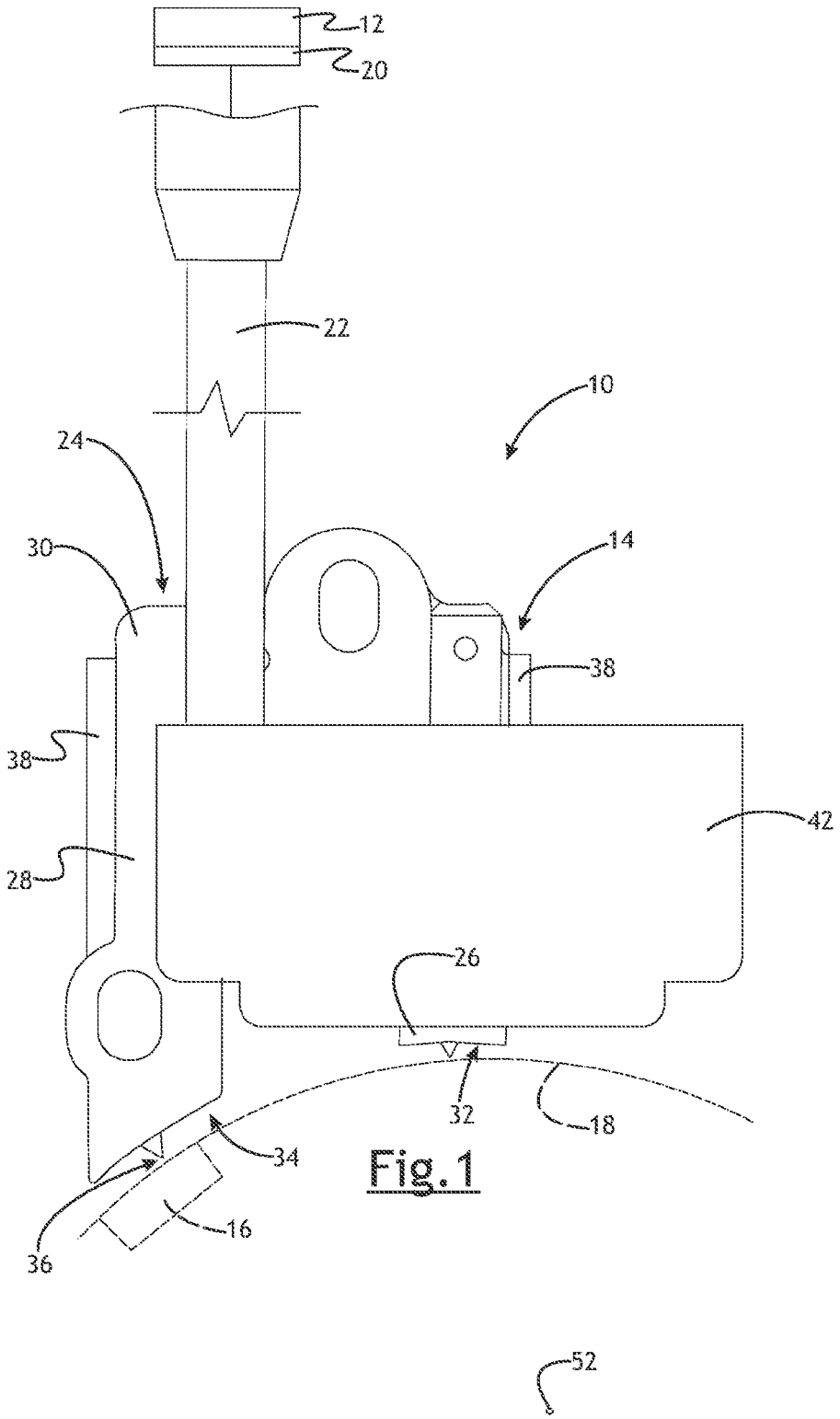
FIG. 1 is a plan view of an ignition control module including a lamstack (shown without wire coils thereon) and a spark plug wire.

Referring in more detail to the drawings, FIG. 1 illustrates one example of an ignition module 10 such as may be used in a capacitive or inductive discharge ignition system to control the ignition events in a light-duty internal combustion engine 12. Typically, the engine is a single cylinder two-stroke or four-stroke gasoline powered internal combustion engine, however engines having more than one cylinder may be used. Typically, the engine does not have any battery supplying an electric current for ignition. Instead, the ignition module 10 harnesses in a stator assembly 14 the energy from one or more magnets 16 carried and rotated by a flywheel 18 (a portion of which is shown in dashed line) of the engine. The ignition module 10 then supplies a high voltage ignition pulse to a spark plug 20 via a spark plug wire 22 for igniting an air and fuel mixture in the engine.

The engine 12 may be manually cranked for starting, such as with a recoil rope starter. The term "light-duty combustion engine" broadly includes all types of non-automotive combustion engines including two and four-stroke gasoline powered engines used in various products including portable electric generators, air compressors, water pumps, power washers, snow blowers, personal watercraft, boats, snowmobiles, motorcycles, all-terrain vehicles, lawn and garden equipment such as garden tractors, tillers, chainsaws, landscape edgers, grass and weed trimmers, air blowers, leaf blowers, etc.

The stator assembly 14 of the ignition module 10 may include a lamination stack 24 (sometimes called a lamstack) that has a first leg 26 and a second leg 28 coupled together by a base 30. The legs 26, 28 may each have a free end 32, 34 arranged in alignment with a periphery of the flywheel 18 and located closely adjacent to the flywheel. In a typical arrangement, a relatively small air gap 36 (which may be about 0.3 mm) is provided between the ends of the legs 26, 28 and the flywheel 18. A plurality of wire coils (diagrammatically shown in FIG. 1 at 38) may be carried by one or both legs, such as a charge coil winding, an ignition primary coil winding and a secondary or trigger coil winding which may be wrapped around one or both legs of the lamstack 24. In at least some implementations, the lamstack 24 may be a generally U-shaped ferrous armature made from a stack of iron plates 40 and may be carried in or by a module housing 42 located on the engine. The ignition primary and secondary coil windings may provide a step-up transformer and as is well known by those skilled in the art, the primary winding may have a comparatively few turns of a relatively heavy gauge wire, while the secondary ignition coil winding may have many turns of a relatively fine wire. The ratio of turns between the primary and secondary ignition windings generates a high voltage potential in the secondary winding that is used to fire a spark plug of the engine to provide an electric arc or spark and consequently ignite an air-fuel mixture in the engine combustion chamber (not shown). Of course, the illustrated lamstack 24 is merely one implementation; e.g., in other embodiments, the coils may be arranged differently on the leg(s), the lamstack 24 may include more than two legs (for example without limitation, a 3-legged lamstack may be generally E-shaped and have 3 legs cantilevered to a base).

The lamstack 24 may be defined by a plurality of the plates 40 that are coupled together in known manner to provide an integral, laminated stack of plates. Each plate 40 may be similar or the same in shape and construction. Each plate 40 may include a base and one or more legs extending from the base, for example, cantilevered from the base such that the plates 40 collectively define the lamstack base 30 and legs 26, 28. One or more of the plates 40 may include alignment features 48 that facilitate aligning and joining together the plurality of plates 40. Non-limiting examples of alignment features include complementary mating or nesting projections and voids, such as a tab and slot or a detent arrangement including a semi-spherical projection and corresponding semi-spherical cavity (i.e. the projection on one plate is received within the cavity of the other plate—by stamping or punching a cavity in a plate, a projection may be formed on the opposite side of the plate as the cavity). Any desired number of plates 40 may be coupled together in a lamstack 24 including, but not limited to, between 5 and 30 plates. The plates 40 may be of any desired thickness and material to provide the desired performance (e.g. magnetic permeability, resistance to eddy current losses) and the legs 26, 28 may be of any desired length to enable use with wire coils of desired wire gauge and numbers of turns. In at least some implementations suitable for use in an ignition system as set forth above, the plates 40 may be between 0.2 and 0.8 mm thick. In one non-limiting example, nineteen (19) plates 40 are coupled together, each plate is about 0.32 mm thick and the total thickness of a leg 26, 28 of the lamstack 24 is about 6 mm+/−0.5 mm.

In the example shown, each leg 26, 28 of the lamstack 24 includes a distal or free end 32, 34 located opposite the end of the leg connected to the base 30. The ends 32, 34 of the legs 26, 28 may be of any desired surface area which is a function of the surface area of the end face 50 (FIGS. 3-5) of each plate 40 and the number of such plates forming the legs 26, 28. The end 32, 34 of each leg 26, 28 may be shaped, if desired, at a constant radius relative to an axis 52 (FIG. 1) of rotation of an adjacent component, such as the flywheel 18. In this way, the outer surface of the end of each leg 26, 28 of the lamstack 24 may be arranged at a radius from the axis 52.

At least one and up to each of the legs 26, 28 of the lamstack 24 may include a location feature 54 arranged to facilitate location of the lamstack 24 relative to an adjacent component. In at least some implementations, the location feature includes one or more projections 54 carried by at least one plate 40 of the stack 24. The projection(s) 54 may extend from the outer surface of the end 32, 34 of one or more of the lamstack legs 26, 28 and be arranged to engage a component adjacent to the lamstack to provide the lamstack at a known distance from the component. In the example shown, a projection 54 extends from the end face 50 of one or more plates 40 of each leg 26, 28 of the lamstack 24 and the projections 54 are designed to engage the flywheel 18 to locate the remainder of the distal end of the lamstack at a known distance from the flywheel.

During engine operation, as the flywheel 18 rotates, the projections 54 will wear down and reduce in length until the projections no longer engage the flywheel 18 or such engagement is not noticeable to a user of the tool or vehicle with which the lamstack 24 and flywheel are associated. This will leave the distal end of the lamstack 24 at a desired distance from the periphery of the flywheel 18 to ensure a desired magnitude of induced energy in the coils 38. This distance between the ends 32, 34 of the legs 26, 28 and the flywheel 18 may be achieved by simple engaging the projections 54 with the flywheel and then securing the lamstack 24 in that position. This may conveniently be done without requiring the use of any gapping tool or separate spacer that must be removed after the lamstack is positioned, as in prior ignition system assembly processes. The use of a gapping tool is labor intensive and requires greater care and time than simply engaging the projections to the flywheel to locate the lamstack in a desired position.

Figure 2:
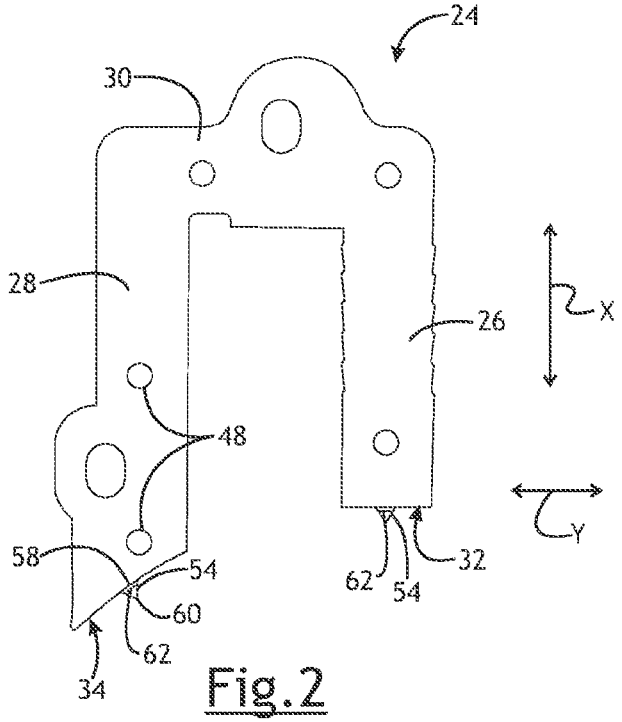
FIG. 2 is a plan view of the lamstack.

In at least some implementations, as shown in FIG. 2, the legs 32, 34 have a length in a longitudinal direction X, a width in a lateral direction Y and a thickness in a vertical direction Z (FIG. 3), where the directions are perpendicular to each other. With this naming convention, the end face 50 of a plate 40 has an area defined by the width and thickness of the plate. In at least some implementations, the projection 54 may extend from the end face 50 of one or more plates 40 and may have a thickness that is the same as or less than the thickness of the plate, and a width that is the same as or less than the width of the leg. As shown in FIGS. 1, 2 and 4, the projections 54 may be generally triangular having a base 58 at the end face 50 and an apex 60 longitudinally spaced from the end face 50. The longitudinal distance between the base 58 and the apex 60 may be chosen to space the end face 50 of the plate 40 a desired distance from the flywheel 18 when the apex 60 is engaged with the flywheel. The distance may be determined with a magnitude of wear of the projection 54 assumed to occur upon rotation of the flywheel 18, where the wear reduces the longitudinal length of the projection, and also reduces the sharpness of or flattens the apex 60. Instead of or addition to an assumed magnitude or range of longitudinal reduction due to wearing of the projection, the projection 54 could include a fracture feature which may be a weakened portion of the projection (shown diagrammatically at 62 in FIG. 2) or the projection could otherwise be constructed so that all or a portion of the projection breaks away from the plate 40 to which it is attached when the flywheel 18 rotates. This may facilitate providing a small gap between the legs 32, 34 and the flywheel 18 and/or reduce scoring or wear of or forces on the flywheel during initial flywheel rotation. The weakened portion 62 may have a reduced width or thickness or comprise a slot or one or more perforations in the projection. While a projection 54 having a point or apex 60 at its outer end provides a reduced surface area of contact with the flywheel 18 and may be preferred in at least some applications, the projection 54 may have any desired shape, including shapes with greater surface area at the free end.

Figure 3:
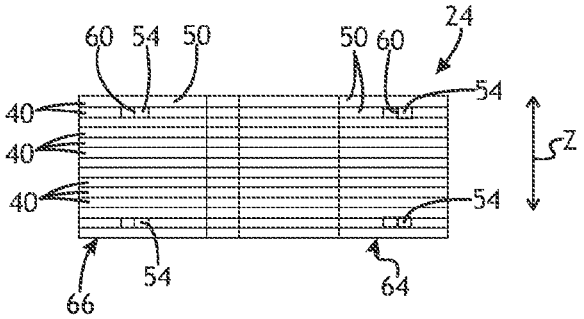
FIG. 3 is an end view of the lamstack.
Figure 4:
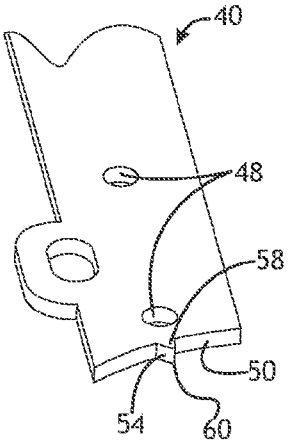
FIG. 4 is an enlarged, fragmentary perspective view of portion of a plate of the lamstack.
Figure 5:
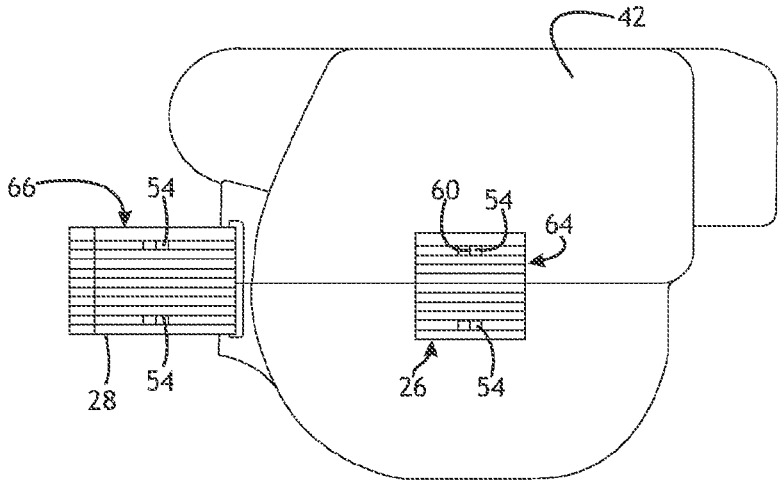
FIG. 5 is an end view of the module of FIG. 1.

As shown in FIGS. 3 and 5, when the plates 40 are joined together into the lamstack 24, the end faces 50 of the first legs of the plates 40 collectively define an end face 64 of the first leg 26 of the lamstack 24, and the end faces of the second legs of the plates 40 collectively define an end face 66 of the second leg 28 of the lamstack. As noted above, one or more projections 54 may extend from one or both of the lamstack legs 26, 28. In at least some implementations, the combined area of the longitudinally outer end of the projections 54 on the first leg 26 of the lamstack 24 is less than 50% of the surface area of that end face 64, and the same may be true of the projections 54 on the second leg 28 of the lamstack. In at least some implementations, the area of the projection(s) 54 at the longitudinally outer end is less than 20% and may be less than 10% of the surface area of the end faces 64, 66 of the lamstack legs 26, 28. In at least some implementations, two projections 54 are provided on an end face 64, 66 of a lamstack leg 26, 28, the projections are triangular, have a thickness the same as the thickness of a plate 40, a base 58 with a lateral width of 0.3 mm to 2 mm and a longitudinal height of 0.1 mm to 0.8 mm, and the end face 64, 66 of the lamstack leg 26, 28 may have a width of between 4 mm and 12 mm, and a thickness of between 2 mm and 16 mm. Hence, each projection 54 may also be less than 50% of the surface area of the end face 50 of the plate 40 to which the projection is connected. Of course, other dimensions may be used, as desired.

Further, if desired, the projections 54 may be located on a plate 40 that is not one of the two outermost plates in the lamstack 24 (e.g. as shown in FIGS. 3 and 5). This may inhibit the plate including the projection 54 from being bent when the flywheel 18 rotates due to the force of engagement between the flywheel and projection. The projections 54 may extend radially, that is, toward the axis 52 of the flywheel 18 (the longitudinal length may be in the radial direction). Multiple projections 54 that are spaced apart on an end face 64, 66 of a lamstack leg 26, 28 may facilitate not only setting a distance of the lamstack 24 relative to the flywheel 18, but also an orientation or attitude of the lamstack to enable more consistent placement of the lamstack relative to the flywheel. This may be done by ensuring that the end of each of the spaced apart projections 54 engages the flywheel 18, and this may be done without a separate tool like a gapping tool or spacer. In at least some implementations, two projections 54 on a lamstack leg 26, 28 may be spaced apart a distance in the vertical direction that is at least 50% of the vertical thickness of that lamstack leg 26, 28.

Figure 6:
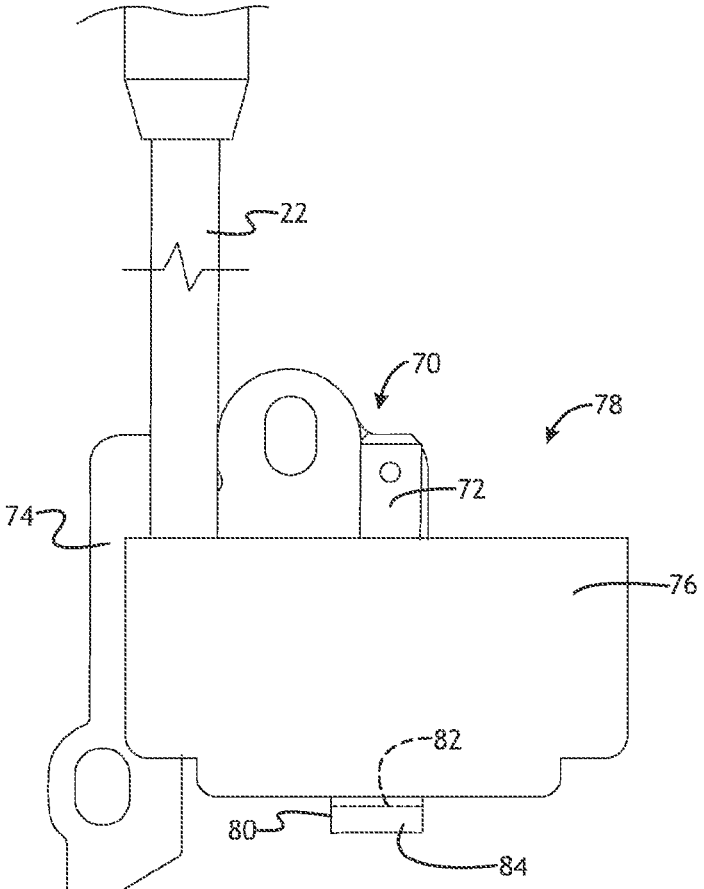
FIG. 6 is a plan view of a module including a lamstack prior to final assembly of the lamstack in the module.
Figure 7:
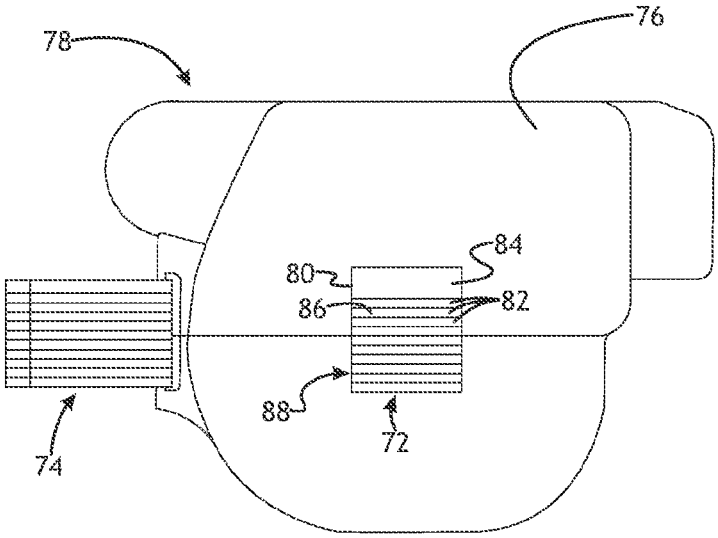
FIG. 7 is an end view of the module showing the lamstack after final assembly of the lamstack in the module.
Figure 8:
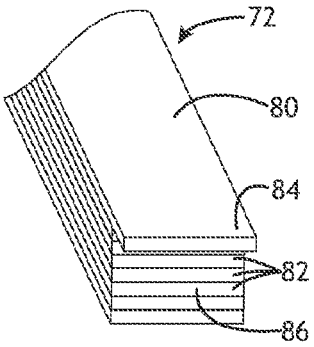
FIG. 8 is an enlarged, fragmentary perspective view of a portion of the lamstack in the state of FIG. 6.
Figure 9:
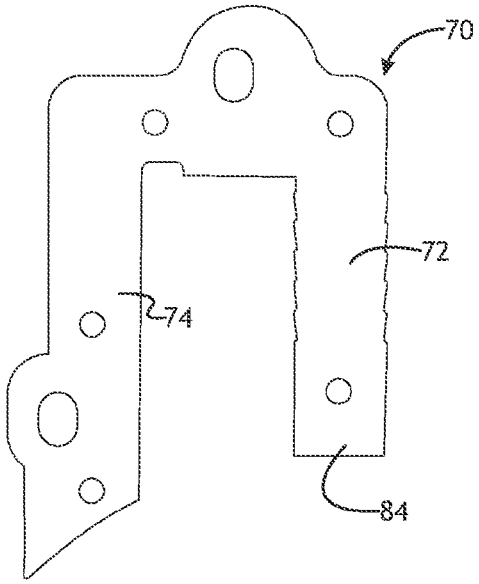
FIG. 9 is a plan view of the lamstack.

In at least some implementations of a lamstack 70, such as shown in FIGS. 6-9, at least one lamstack leg 72, 74 may include a different location feature. This location feature may be adapted to secure the lamstack 70 to a housing 76 of the ignition module 78 and/or to limit relative movement between the lamstack 70 and housing 76, such as may occur due to vibrations and forces on these components in use. In this example, the location feature is defined by or on at least one leg of at least one plate 80 of the lamstack 70 being longer than the same leg(s) of other plates 82 in the lamstack 70 as shown in FIG. 8. The longer leg(s) provides a tab or projection 84 extending from an end face 86 of a lamstack leg 72, 74 as shown in FIGS. 6, 8 and 9.

The projection 84 may be bent relative to the module housing 76, as shown in FIG. 7, so that the projection overlies part of the housing and provides a stop surface that limits or prevents movement of the lamstack 70 relative to the housing 76 in at least one direction. In at least some implementations, the projection 84 is provided on one or both of the two outermost plates in the lamstack 70. This may facilitate bending the projection 84 relative to and away from the other plates 82 and doing so with the bent projection 84 not extending longitudinally outwardly relative to the end faces 86 of the other plates 82 in that lamstack leg.

As shown in FIG. 7, the resulting end face 88 of the lamstack leg 72 has a greater dimension in the thickness direction due to the projection 84 being bent away from the other plates in that direction. While FIG. 7 shows one of the outermost end plates 80 of the first lamstack leg 72 being bent, both of the outermost plates may include such a projection and they may each be bent outwardly, away from the other plates. This would provide two areas or retention or motion limiting between the lamstack and housing. Likewise, one or both end plates of the second lamstack leg 74 may also include a projection 84 that is bent relative to the other plates and the module housing 76.

While the example shown has the projection 84 being the same width and thickness of the plate from which it extends, the projection may have any desired shape. For example, the projection 84 may be less wide than the leg of the plate to facilitate bending the projection. With a thinner or less wide projection, the projection may be bent in a different direction than simply away from the other plates in the thickness and longitudinal directions to facilitate overlapping a desired portion of the housing, or for another reason. In at least some implementations, the projection is at least 1 mm in length to facilitate engaging and bending the projection with a tool.

Additionally, in at least some implementations, one or both of the outermost plates of the lamstack may be longer than a plate adjacent to the outer plate by way of the adjacent plate being shorter than the outer plate. One or more plates adjacent to at least one of the outer plates may be shorter than the outer plate to enable the outer plate(s) to be bent relative to the adjacent plates. To facilitate bending the outer plate relative to the other plates, in at least some implementations, the adjacent plate or plates is/are at least 1.5 mm shorter than the outer plate.

Accordingly, a lamstack 24, 70 may include one or more location features. The location features may facilitate positioning the lamstack 24, 70 in a desired position relative to a flywheel 18 or another component like a housing of a module with which the lamination stack is used. In the non-limiting examples shown, the location features include one or more projections 54 adapted to engage a flywheel 18 to locate the end of the lamstack 24 a desired distance from the flywheel, and/or the location features include one or more projections 84 extending from one or more plates and adapted to be bent relative to the remainder of the lamstack 76 to, for example overlap and engage an ignition module housing 76 to limit or prevent relative movement between the lamstack and housing. Of course, constructions and arrangements other than those shown here may be utilized in accordance with the general concepts set forth herein, and location features of both types 54, 84 may be used in the same lamstack.

In that regard, the forms of the invention herein disclosed constitute presently preferred embodiments and many other forms and embodiments are possible. It is not intended herein to mention all the possible equivalent forms or ramifications of the invention. It is understood that the terms used herein are merely descriptive, rather than limiting, and that various changes may be made without departing from the spirit or scope of the invention.

What is claimed is:

1. A lamination stack, comprising:

a plurality of plates coupled together, each plate including at least one leg that collectively define a leg of the stack, with the leg of the stack arranged so that a wire coil may be arranged on the leg of the stack, and wherein the leg of the stack includes a location feature arranged to facilitate location of the stack relative to an adjacent component, wherein the location feature includes at least one projection extending from one or more of the plates.

2. The stack of claim 1 wherein the location feature is integrally formed with at least one of the plates.

3. The stack of claim 1 wherein the coupled together plates define a pair of outer plates at each side of the stack and the location feature is defined by at least one of the plates adjacent to an outer plate which is shorter than the outer plate.

4. The stack of claim 3 wherein the said at least one of the plates adjacent to an outer plate is at least 1.5 mm shorter than the adjacent outer plate.

5. The stack of claim 1 wherein the projection includes a fracture feature providing a location at which the projection will break away from said one or more of the plates.

6. The stack of claim 5 wherein the fracture feature is defined by a weakened portion of a projection.

7. The stack of claim 1 wherein the coupled together plates define a pair of outer plates at each side of the stack and the location feature is defined by at least one of the outer plates which is longer than a plate adjacent to the longer plate.

8. The stack of claim 7 wherein the longer plate extends at least 1 mm beyond the plate adjacent to the longer plate.

9. The stack of claim 1 wherein the projection is constructed to engage the adjacent component and to be worn down by movement of the adjacent component relative to the projection.

10. The stack of claim 1 wherein the projection has a surface area at an outer end of the projection that is less than ⅓ of the surface area of the end of the leg of the stack.

11. The stack of claim 1 wherein the projection extends from the end of a plate by a distance of 0.7 mm or less.

12. An assembly, comprising:

a stack defined by a plurality of plates that are coupled together, the stack having a first leg and a second leg spaced from the first leg, wherein each plate includes at least two legs and the legs of each plate collectively define the first and second legs of the stack, and wherein each leg of the stack includes a location feature arranged to facilitate location of the stack relative to an adjacent component; and at least one coil located on one leg of the stack and at least one other coil located on the other leg of the stack, wherein the location feature is one or both of: a) at least one projection extending from one or more of the plates, and b) constructed to engage the adjacent component in initial assembly and to be worn down by movement of the adjacent component relative to the projection.

13. The stack of claim 12 wherein the projection includes a fracture feature providing a location at which the projection will break away from said one or more of the plates.

14. The stack of claim 13 wherein the fracture feature is defined by a weakened portion of a projection.

15. The assembly of claim 12 wherein the first leg and second leg are coupled together by a base, and wherein each plate includes a base extending between said at least two legs of each plate.

16. The assembly of claim 12 wherein the first leg and second leg include a free end and wherein the location feature is arranged at the free end of at least one of the first leg and the second leg.

17. The assembly of claim 16 wherein the location feature includes at least one projection extending from a free end of at least one leg of at least one plate.

18. The assembly of claim 17 wherein the projection has an outer end and a surface area at the outer end of the projection that is less than ⅓ of the surface area of the end of the leg of the stack on which the projection is provided.

* * * * *